US007645305B1

(12) United States Patent
Coleman et al.

(10) Patent No.: US 7,645,305 B1
(45) Date of Patent: Jan. 12, 2010

(54) HIGH STABILITY FUEL COMPOSITIONS

(75) Inventors: Gerald N. Coleman, Peoria, IL (US); Dennis L. Endicott, Mapleton, IL (US); Edward A. Jakush, Evanston, IL (US)

(73) Assignee: Clean Fuels Technology, Inc., Reno, NV (US)

( * ) Notice: Subject to any disclaimer, the term of this patent is extended or adjusted under 35 U.S.C. 154(b) by 0 days.

(21) Appl. No.: 09/108,447

(22) Filed: Jul. 1, 1998

(51) Int. Cl.
*C10L 1/32* (2006.01)

(52) U.S. Cl. ..... 44/301; 44/302; 44/324; 44/375; 44/379; 44/404; 44/408; 44/447; 44/450

(58) Field of Classification Search ..... 44/301, 44/302

See application file for complete search history.

(56) References Cited

U.S. PATENT DOCUMENTS

| | | | | | |
|---|---|---|---|---|---|
| 3,490,237 | A | * | 1/1970 | Lissant | 44/301 |
| 3,527,581 | A | * | 9/1970 | Brownawell et al. | 44/301 |
| 3,756,794 | A | * | 9/1973 | Ford | 44/301 |
| 4,083,698 | A | * | 4/1978 | Wenzel et al. | |
| 4,447,348 | A | * | 5/1984 | Forsberg | 252/75 |
| 4,907,368 | A | * | 3/1990 | Mullay et al. | 44/301 |
| 5,284,492 | A | * | 2/1994 | Dubin | 44/301 |
| 5,344,306 | A | * | 9/1994 | Brown et al. | 44/301 |
| 5,584,894 | A | * | 12/1996 | Peter-Hoblyn et al. | 44/301 |
| 5,669,938 | A | * | 9/1997 | Schwab | 44/301 |
| 5,670,739 | A | * | 9/1997 | Patterson et al. | 149/2 |
| 5,743,922 | A | * | 4/1998 | Peter-Hoblyn et al. | 44/301 |
| 5,873,916 | A | * | 2/1999 | Cemenska et al. | 44/301 |
| 6,280,485 | B1 | * | 8/2001 | Daly et al. | 44/301 |
| 6,368,366 | B1 | * | 4/2002 | Langer et al. | 44/301 |
| 6,368,367 | B1 | * | 4/2002 | Langer et al. | 44/301 |
| 6,383,237 | B1 | * | 5/2002 | Langer et al. | 44/301 |
| 6,530,964 | B2 | * | 3/2003 | Langer et al. | 44/301 |
| 6,607,566 | B1 | * | 8/2003 | Coleman et al. | 44/301 |
| 6,648,929 | B1 | * | 11/2003 | Daly et al. | 44/301 |
| 6,652,607 | B2 | * | 11/2003 | Langer et al. | 44/301 |
| 6,656,236 | B1 | * | 12/2003 | Coleman et al. | 44/301 |
| 6,827,749 | B2 | * | 12/2004 | Westfall et al. | 44/301 |
| 6,858,046 | B2 | * | 2/2005 | Daly et al. | 44/301 |

FOREIGN PATENT DOCUMENTS

| | | |
|---|---|---|
| WO | 93/07238 | 4/1993 |
| WO | 95/27021 | 10/1995 |
| WO | 97/08276 | 3/1997 |
| WO | 98/12285 | 3/1998 |

* cited by examiner

*Primary Examiner*—Ellen M McAvoy
(74) *Attorney, Agent, or Firm*—Lewis and Roca LLP

(57) ABSTRACT

Improved highly stable formulation for aqueous fuel emulsion compositions with a water continuous phase, having reduced NOx emissions. The fuel emulsion formulation includes diesel fuel, purified water, and an additive package that includes one or more surfactants, lubricity additive, cetane improver, anti-corrosion additive, and an alcohol or other suitable antifreeze, the emulsion having an average droplet size of less than 10 microns.

19 Claims, No Drawings

HIGH STABILITY FUEL COMPOSITIONS

BACKGROUND OF THE INVENTION

The present invention relates to reduced nitrogen oxide (NOx) emission fuel compositions, more particularly, to high stability fuel compositions for use in internal combustion engines.

Nitrogen oxides comprise a major irritant in smog and are believed to contribute to tropospheric ozone which is a known threat to health. Environmental considerations and government regulations have increased the need to reduce NOx production. One problem with using diesel-fueled engines is that the relatively high flame temperatures reached during combustion increase the tendency for the production of nitrogen oxides (NOx). These are formed from both the combination of nitrogen and oxygen in the combustion chamber and from the oxidation of organic nitrogen species in the fuel. Various methods for reducing NOx production include the use of catalytic converters, engine timing changes, exhaust recirculation, and the burning of "clean" fuels. These methods are generally too expensive and/or too complicated to be placed in widespread use. The rates at which NOx are formed is related to the flame temperature. It has been shown that a small reduction in flame temperature can result in a large reduction in the production of nitrogen oxides.

One approach to lowering the flame temperature is to inject water in the combustion zone, however; this requires costly and complicated changes in engine design. An alternate method of using water to reduce flame temperature is the use of aqueous fuels incorporating both water and fuel into an emulsion. Gravitational phase separation (during storage) and high temperature high pressure/shear flow rate phase separation (in a working engine) of these emulsions present the major hurdle preventing their commercial use.

Additional problems that may occur from long-term use of aqueous fuels include engine corrosion, engine wear, or precipitate deposition which may lead to engine problems and ultimately to engine inoperability. Problematic precipitate depositions include coalescing ionic species resulting in filter plugging and inorganic post combustion deposits resulting in turbo fouling. Another problem related to aqueous fuel compositions is that they often require substantial engine modifications, such as the addition of in-line homogenizers, thereby limiting their commercial utility.

The present invention addresses the problems associated with the use of aqueous fuel compositions by providing a stabile, inexpensive fuel emulsion with reduced NOx and particulate emissions.

SUMMARY OF THE INVENTION

In general, the invention features a substantially ashless fuel composition that comprises hydrocarbon petroleum distillate, purified water, and an additive composition. The fuel composition preferably is in the form of an emulsion which is stable at storage temperatures, as well as, at temperatures and pressures encountered during use, such as, during recirculation in a compression ignited engine.

The amount of the hydrocarbon petroleum distillate preferably is between about 43 weight percent and about 70 weight percent of the fuel composition, more preferably between about 63 weight percent and about 68 weight percent of the fuel composition.

The amount of purified water preferably is between about 28 weight percent and about 55 weight percent of the fuel composition, more preferably between about 30 weight percent and about 35 weight percent of the fuel composition. The purified water preferably contains no greater than about 50 parts per million calcium and magnesium ions, and no greater than about 20 parts per million silicon. More preferably, the purified water has a total hardness of less than 10 parts per million and contains no greater than about 2 parts per million calcium and magnesium ions, and no greater than about 1 part per million silicon.

The additive composition preferably includes a surfactant and may also include one or more additives such as lubricants, corrosion inhibitors, antifreezes, ignition delay modifiers, cetane improvers, stabilizers, rheology modifiers, and the like. Individual additive ingredients may perform one or more of the aforementioned functions.

The preferred emulsion has an average droplet diameter of less than about 10 microns.

DESCRIPTION OF PREFERRED EMBODIMENTS

Preferred fuel compositions include hydrocarbon petroleum distillates and water in the form of an emulsion. The preferred emulsion is a stable system with as little surfactant as possible. A stable emulsion is desirable because a separate water and fuel phases will lead to combustion problems. Stability means no substantial phase separation in long term storage under typical storage conditions, for example, up to about three months. The fuel emulsions have the high temperature and high pressure stability required to maintain the emulsion under operating conditions.

The fuel composition is preferably ashless. For the purposes of this disclosure "ashless" means that, once the fuel components are combined, the level of particulates and coalescing ionic species is sufficiently low to allow long-term operation of the internal combustion engine (for example, substantially continuous operation for three months) without significant particulate and coalescing ionic species deposition on engine parts, including valve seats and stems, injectors and plug filters, and post-combustion engine parts such as the exhaust trains and turbo recovery units. The level of ash is determined by monitoring water purity, exhaust emissions, and by engine autopsy. Engine autopsy, including dismantlement and metallurgical analysis, is also used to analyze corrosion and wear.

Preferred compositions include about 43% to about 70% by weight hydrocarbon petroleum distillate, more preferably about 63% to about 68% hydrocarbon petroleum distillate. The amount and type of hydrocarbon petroleum distillate is selected so that the kilowattage per gallon provided by combusting the fuel composition is sufficiently high so that the engine need not be derated. Examples of suitable hydrocarbon petroleum distillates include kerosene, diesel, naphtha, and aliphatics and paraffinics, used alone or in combination with each other, with diesel being preferred, for example, EPA Emissions Certification Diesel Fuel and standard number 2 diesel. Suitable hydrocarbon petroleum distillates include high paraffinic, low aromatic hydrocarbon petroleum distillates having an aromatic content of less than about 10%, preferably less than about 3%.

The water component of the fuel composition functions to reduce NOx and particulate emissions. The greater the amount of water, the greater the decrease in $NO_x$ emissions. The current upper limit of water is about 55%, above which the burning characteristics of the fuel make it's use impractical under normal conditions, i.e., with an acceptable amount of additives and relatively inexpensive hydrocarbon petroleum distillate. The preferred amount of purified water is between about 28 weight percent and about 55 weight percent of the fuel composition, more preferably between about 30 weight percent and about 35 weight percent of the fuel composition.

The water is preferably purified such that it contains very low concentrations of ions and other impurities, particularly calcium ions, magnesium ions, and silicon. This is desirable because impure water contributes to ashing and engine deposit problems after long-term use, which can lead to wear, corrosion, and engine failure. The purified water preferably contains no greater than about 50 parts per million calcium and magnesium ions, and no greater than about 20 parts per million silicon. More preferably, the purified water has a total hardness of less than 10 parts per million and contains no greater than about 2 parts per million calcium and magnesium ions, and no greater than about 1 part per million silicon. Suitable purification techniques are well-known and include distillation, ion exchange treatment, and reverse osmosis, with reverse osmosis being preferred having a lower cost and ease of operation.

The fuel composition preferably includes one or more additives, for example, surfactants, lubricants, corrosion inhibitors, antifreezes, ignition delay modifiers, cetane improvers, stabilizers, rheology modifiers, and the like. The amount of additive selected is preferably sufficiently high to perform its intended function and, preferably sufficiently low to control the fuel composition cost. The additives are preferably selected so that the fuel composition is ashless.

In a preferred embodiment the water functions as the continuous phase of an emulsion, acting as an extender and carrier of the hydrocarbon petroleum distillate. As the continuous phase, the lower useable limit of water is theoretically about 26%, below which point the physics of the system inhibits maintaining water as the continuous phase.

The preferred composition includes surfactant which facilitates the formation of a stable emulsion of the hydrocarbon petroleum distillate within the continuous water phase. A preferred surfactant is a surfactant package comprised of one or more surfactants in combination with one or more surfactant stabilizers. Preferred surfactants are ashless and do not chemically react with other components in the fuel composition. Examples of suitable surfactants include nonionic, anionic and amphoteric surfactants. Preferred fuel compositions include about 0.3% to about 1.0% by weight, preferably about 0.4% to about 0.6% total surfactant.

Examples of suitable components for the surfactant package include alkylphenolethoxylates, alcohol ethoxylates, fatty alcohol ethoxylates, and alkyl amine ethoxylates. Of these, the alkylphenolethoxylates and alcohol ethoxylates are preferred. Of the alkylphenolethoxylates, polyethoxylated nonylphenols having between 8 and 12 moles of ethylene oxide per mole of nonylphenol are preferred. An example nonylphenol, 2,6,8-Trimethyl-4-nonyloxypolyethyleneoxyethanol is commercially available, e.g., from Union Carbide under the trade designation "TERGITOL TMN-10". Another nonylphenol ethoxylate NP-9 available from Shell under the trade designation "NP-9EO", added at 1000-3000 ppm. A preferred alcohol ethoxylate is a $C_{11}$ alcohol ethoxylate with 5 moles of ethylene oxide per mole of alcohol commercially available from Shell as "NEODOL N1-5 SURFACTANT". Additional preferred surfactant components include, for example, Pluronic 17R-2 [octylphenoxypolyethoxyethanol] (a block copolymer produced by BASF) added at 100-300 ppm; CA-720 an octylphenol aromatic ethoxylate available from Rhone-Poulenc as "IGEPAL CA-720" added at 1000-3000 ppm; and X-102 an ethoxylated alkyl phenol available from Union Carbide as "TRITON X-102" added at 1000-2000 ppm.

The fuel composition preferably includes one or more lubricants to improve the slip of the water phase and for continued smooth operation of the fuel delivery system. The amount of lubricant generally ranges from about 0.04% to 0.1% by weight, more preferably from 0.04% to 0.05% by weight. Suitable lubricants include a combination of mono-, di-, and tri-acids of the phosphoric or carboxylic types, adducted to an organic backbone. The organic backbone preferably contains about 12 to 22 carbons. Examples include mixed esters of alkoxylated surfactants in the phosphate form, and di- and tri-acids of the Diels-Alder adducts of unsaturated fatty acids. The carboxylic types are more preferred because of their ashless character. A specific example of a suitable lubricant is DIACID 1550™ (Altrachem "LATOL 1550" or Westvaco Chemicals "DIACID 1550"), which is preferred due to its high functionality at low concentrations. The DIACID 1550 also has nonionic surfactant properties. Neutralization of the phosphoric and carboxylic acids, preferably with an alkanolamine, reduces possible corrosion problems caused as a result of the addition of the acid. Suitable alkanolamine neutralizers include amino methyl propanol, triethanolamine, and diethanolmaine, with amino methyl propanol (available from Angus Chemical under the trade designation "AMP-95") begin preferred. Preferred compositions include about 0.05 to 0.4% by weight neutralizer, more preferably about 0.06%.

The fuel composition may also include one or more corrosion inhibitors, preferably one that does not contribute a significant level of inorganic ash to the composition. Aminoalkanoic acids are preferred. An example of a suitable corrosion inhibitor is available from the Keil Chemical Division of Ferro Corporation under the trade designation "SYNKAD 828". Preferred compositions include about 0.05% by weight corrosion inhibitor.

The fuel composition may also include one or more ignition delay modifiers, preferably a cetane improver, to improve fuel detonation characteristics, particularly where the fuel composition is used in compression ignited engines. Examples include nitrates, nitrites, and peroxides. A preferred ignition delay modifier is 2-ethylhexylnitrate (2-EHN), available from Ethyl Corporation under the trade designation "HITECH 4103". Ammonium nitrate can also be used as a cetane improver with the additional benefit of possessing emulsion stabilization properties. Preferred compositions include about 0.1% to 0.4% by weight ignition delay modifier.

An antifreeze may also be included in the fuel composition. Organic alcohols are preferred. Specific examples include methanol, ethanol, isopropanol, and glycols, with methanol being preferred. The amount of antifreeze preferably ranges from about 2% to about 9% by weight.

Biocides known to those skilled in the art may also be added, provided they are ashless. Antifoam agents known to those skilled in the art may be added as well, provided they are ashless. The amount of antifoam agent preferably is not more than 0.0005% by weight.

The fuel composition may also include one or more coupling agents (hydrotropes) to maintain phase stability at high temperatures and shear pressures. High temperature and shear pressure stability is required, for example, in compression ignited (diesel) engines because all the fuel delivered to the injectors may not be burned to obtain the required power load in a given cycle. Thus, some fuel may be recirculated back to the fuel tank. The relatively high temperature of the recirculated fuel, coupled with the shear pressures encountered during recirculation, tends to cause phase separation in the absence of the coupling agent. Examples of preferred coupling agents include di- and tri-acids of the Diels-Alder adducts of unsaturated fatty acids. A specific example of a suitable coupling agent is DIACID 1550, neutralized with an alkanolamine to form a water soluble salt. Suitable alkanolamine neutralizers include amino methyl propanol triethanolamine, and diethanolamine, with amino methyl propanol preferred. The amount of the coupling agent typically ranges from about 0.04% to 0.1% by weight, more preferably 0.04 to 0.05%.

The fuel composition additives may perform multiple functions. For example, DIACID 1550 acts as a surfactant, lubricant, and coupling agent. Similarly, AMP-95 acts as a neutralizer and helps maintain the pH of the fuel composition and ammonium nitrate acts as a known cetane improver.

A preferred fuel composition has the following composition: 67% by weight diesel, 30% by weight water, 2% by weight methanol, 0.16% by weight X-102; 0.08% by weight N1-5; 0.08% by weight TMN-10, 0.04% Diacid 1550, 0.06% AMP-95, 0.05% Synkad 828, and 0.37% 2-ethylhexylnitrate.

Emulsion Process

The preferred fuel emulsion compositions may be manufactured using any batch or continuous process capable of providing the shear rates necessary to form the desired droplet size of a stable emulsion.

In the batch process, the oil phase ingredients (e.g., the hydrocarbon petroleum distillate and any other oil-soluble ingredients) are charged to a stirred tank reactor along with the surfactant. The aqueous phase ingredients (e.g., water and any other water-soluble additives) are combined separately and then pumped into the reactor, where they are combined with agitation with the oil phase ingredients to form an emulsion. When the concentration of water has reached a sufficiently high level, phase inversion occurs, resulting in water being the continuous phase.

The resulting emulsion is aged and then transferred from the reactor into a storage tank using a shear pump. The resulting product is a stable, homogeneous, milky emulsion having an average droplet diameter less than about 10 microns, preferably ranging from about 4 to about 6 microns.

In an example of a continuous process, the ingredients (with the exception of the hydrocarbon petroleum distillate and the water) are combined in the form of a stream, and then fed to a first in-line blending station where they are combined with a hydrocarbon petroleum distillate stream. The resulting product is then combined with water in a second in-line blending station to form the fuel composition, which is then aged and pumped using a shear pump to a storage tank. As in the case of the batch process, the product is in the form of a stable, homogeneous, milky emulsion having an average droplet diameter of less than 10 microns, preferably ranging from about 4 to about 6 microns.

Examples of shear pumps capable of the necessary shear rates are the Ross X Series mixer and the Kady mill. A Kady Mill is preferred for manufacturing water continuous emulsions, running at between 20 Hz to about 60 Hz, preferably about 40 Hz.

Engine Design

The fuel compositions according to the invention can be used in internal combustion engines without substantially modifying the engine design. For example, the fuel compositions can be used without re-designing the engine to include in-line homogenizers. To enhance fuel efficacy, however, several readily implemented changes are preferably incorporated in the engine structure.

The capacity of the engine fuel system may be increased to use the fuel compositions in diesel engines. The increased capacity is a function of the percentage of water in the fuel. The engine fuel system capacity is typically scaled by the following ratio:

Lower Heating Value of Diesel Fuel (btu/gal)

Lower Heating Value of Fuel Composition (btu/gal)

In many cases, the engine fuel system capacity can be increased sufficiently by increasing the injector orifice size. Other engines may require an increase in the capacity of the injection pump. In addition, an increase in the capacity of the fuel transfer pump may be required.

Some modifications to the engine may be required to compensate for fuel compositions with cetane quality lower than diesel fuel. This may include advancing the fuel injection timing to improve operation at light load, during starting, and under warm up conditions. In addition, a jacket water aftercooler may be required to warm the intake air under light load conditions. The use of a block heater or an inlet air heater may be required to improve cold starting capability.

The following examples will further describe the invention. These examples are intended only to be illustrative. Other variations and modifications may be made in form and detail described herein without departing from or limiting the scope of the invention which is determined by the attached claims.

EXAMPLE 1

An fuel composition having the following formula was prepared:

| | Ppm | Percent |
|---|---|---|
| Diesel | (balance | 67% |
| H2O | 300,000 | 30.00% |
| MeOH | 20,000 | 2.00% |
| X-102 | 1,600 | 0.16% |
| N1-5 | 800 | 0.08% |
| TMN-10 | 800 | 0.08% |
| DA-1550 | 400 | 0.04% |
| AMP-95 | 600 | 0.06% |
| SYNKAD 828 | 500 | 0.05% |
| 2-EHN | 3,700 | 0.37% |

The fuel composition was prepared by first mixing the DIACID 1550, AMP-95, SYNKAD 828, X-102, N1-5, and TMN-10 with the methanol. The mixture was agitated.

The mixture was charged into a vessel with the reverse osmosis purified water and agitated for about 1-5 minutes. Then the Diesel Fuel and 2-ethylhexyl nitrate were charged into the vessel, and the composition was agitated for 15-30 minutes. The mixing vessel was a Lightnin Blender, and all mixing was carried out under ambient conditions.

The fuel composition was then pumped through a Kady Mill shear pump at a rate of 40 Hz resulting in a homogeneous, milky emulsion having an average droplet diameter of about 4 to about 6 microns. The fuel composition was stored at ambient temperatures.

EXAMPLE 2

A fuel composition was prepared by the method of Example 1, having the formula:

| | |
|---|---|
| Diesel Fuel | 67% |
| Highly purified water | 30% |
| Methanol | 2.00% |
| 2-EHN | 0.37% |
| DA-1550 | 400 ppm |
| AMP 95 | 600 ppm |
| SYNKAD 828 | 500 ppm |
| N1-5 | 1000 ppm |
| NP9 | 3000 ppm |

EXAMPLE 3

A fuel composition was prepared by the method of Example 1 having the formula:

| | |
|---|---|
| Diesel Fuel | 67% |
| Highly purified water | 30% |
| Methanol | 2.00% |
| 2-EHN | .37% |
| DA-1500 | 400 ppm |
| AMP 95 | 600 ppm |
| SYNKAD 828 | 500 ppm |
| TMN 10 | 1000 ppm |
| NP 9 | 2000 ppm |
| 17R2 | 100 ppm |

EXAMPLE 4

A fuel composition was prepared by the method of Example 1, having the formula:

| | |
|---|---|
| Diesel Fuel | 67% |
| Highly purified water | 30% |
| Methanol | 2.00% |
| 2-EHN | 0.37% |
| DA-1550 | 400 ppm |
| AMP 95 | 600 ppm |
| SYNKAD 828 | 500 ppm |
| N1-5 | 1000 ppm |
| TMN10 | 1000 ppm |
| CA720 | 2000 ppm |

For Examples 1-4: the diesel fuel was EPA Emissions Certification Diesel Fuel; the water was purified by reverse osmosis; X-102 is Union Carbide Triton X-102; TMN-10 is Union Carbide Tergitol TMN-10 surfactant; N1-5 is Shell Neodol N1-5 surfactant; DA-1550 is ATRACHEM LATOL 1550 (or Westavco Chemicals DIACID 1550); AMP-95 is 2-amino-2-methyl-1-propanol; SYNKAD 828 is Ferro SYNKAD 828; 2-EHN is Ethyl Corp. 2-ethylhexyl nitrate; CA-720 is Rhone-Poulenc "IGEPAL CA-720"; NP 9 is Shell "NP-9EO"; and 17R2 is BASF "PLURONIC 17R-2".

EXAMPLE 5

The fuel compositions prepared according to Examples 1, 2, 3, and 4 were run in a diesel engine to monitor NOx and particulate emissions. The engine used was a Caterpillar 12 liter compression-ignited truck engine (four stroke, fully electronic, direct injected engine with electronic unit injectors, a turbocharger, and a four valve quiescent head) The Caterpillar C-12 truck engine was rated at 410 hp at 1800 rpm with a peak torque of 2200 N-m at 1200 rpm and was modified to run a fuel-in-water emulsion. A simulated air-to-air aftercooler (43° C. inlet manifold temperature) was used.

The electronic unit injectors were changed to increase the quantity of fuel injected into the cylinder. As modified, the electronic unit injector Caterpillar Part Number 116-8800 replaced the standard injector Caterpillar Part Number 116-8888. In addition, the electronic control strategy was optimized with respect to emissions, fuel consumption, and cold starting.

Tests were performed on standard diesel fuels and on fuel emulsions of Example 1 and fuel emulsions prepared as in Example 1 in which the diesel fuel was Carb Diesel; RME (Rapeseed Methyl Ester); and Fischer Tropsch diesel. The tests were performed at 1800 rpm and 228 kW, 122 rpm and 197 kW, and 1800 rpm and 152 kW. Particulate emissions and NOx+HC emissions for standard diesel fuels and for fuel emulsions are shown in the following table:

| Engine | | Standard diesel fuel | Fuel emulsions |
|---|---|---|---|
| 1800 rpm 228 kW | Particulate emissions (g/hp-hr) | about 0.040 to about 0.055 | about 0.025 to about 0.055 |
| | NOx + HC emissions (g/hp-hr) | about 2.5 to about 4.5 | about 1.0 to about 2.8 |
| 1200 rpm 197 kW | Particulate emissions (g/hp-hr) | about 0.03 to about 0.033 | about 0.028 to about 0.1 |
| | NOx + HC emissions (g/hp-hr) | about 3.5 to about 6.5 | about 1.5 to about 4.2 |
| 1800 rpm 152 kW | Particulate emissions (g/hp-hr) | about 0.068 to about 0.084 | about 0.038 to about 0.050 |
| | NOx + HC emissions (g/hp-hr) | about 2.3 to about 4.5 | about 1.1 to about 2.7 |

EXAMPLE 6

The Ball on Three Disks (BOTD) lubricity test was utilized to assess the lubricity of the fuel compositions. This test was developed by Falex Corporation to assess the lubricity of various diesel fuels and their additives. The average wear scar diameter is used to assess fuel composition lubricity; a smaller scar diameter implies a higher fuel composition lubricity. Typical diesel fuel will have a scar diameter of 0.45 mm to 0.55 mm. Fuel emulsions of Example 1 and fuel emulsions prepared as in Example 1 in which the diesel fuel was Carb Diesel; RME (Rapeseed Methyl Ester); and Fischer Tropsch diesel, ranged from about 0.547 to about 0.738.

What is claimed is:

1. A high-stability, low emission, fuel emulsion composition for a reciprocating engine comprising:

purified water being substantially 28-50% by weight of said fuel emulsion composition wherein water is a continuous phase of said fuel emulsion;

hydrocarbon petroleum distillate being substantially 43-70% by weight of said fuel emulsion; and additives being at least 1% by weight of said fuel emulsion wherein said additives includes:

an ignition delay modifier being substantially 0.1%-0.4% by weight of said fuel emulsion wherein said ignition delay modifier improves fuel detonation characteristics of said fuel emulsion and includes Ammonium Nitrate that acts as an emulsion stabilizer, a neutralizer being substantially 0.05%-0.4% by weight of said fuel emulsion wherein said neutralizer reduces corrosion caused by acids in said fuel emulsion, a coupling agent substantially 0.04%-0.1% by weight of said fuel emulsion wherein said coupling agent maintains phase stability of said fuel emulsion at high temperatures and shear pressures of an internal combustion engine and wherein said coupling agent is a water soluble salt formed from the neutralization reaction of an acid selected from a group consisting of: a di-acid of the Diels-Alder adducts of unsaturated fatty acids and a tri-acid of the Diels-Alder adducts of unsaturated fatty acids and an alkanolamine, and at least one additive selected from a group consisting of:

a surfactant being substantially 0.3%-1% by weight of said fuel emulsion wherein said surfactant facilitates formation of a stable emulsion of said hydrocarbon distillate within said continuous phase of water, a lubricant being 0.04% to 0.1% by weight of said emulsion to improve lubricity of said fuel emulsion, a corrosion inhibitor being substantially 0.05% by weight of said fuel emulsion, and biocides being less than 0.0005% by weight of said fuel emulsion wherein said biocides are an anti-foam agent.

2. The fuel emulsion of claim 1 wherein said surfactant includes at least one selected from the group consisting of: an alkylphenolethoxylate, an alcohol ethoxylate, a fatty alcohol ethoxylate, and an alkyl amine ethoxylate.

3. The fuel emulsion of claim 2 wherein a selected alkylphenolethoxylate is a polyethoxylated nonylphenol having between 8 and 12 moles of ethylene oxide per mole of nonylphenol.

4. The fuel emulsion of claim 3 wherein said nonylphenol is 2,6,8-Trimethyl-4-nonyloxypolyethyleneoxyethanol.

5. The fuel emulsion of claim 3 wherein said polyethoxylated nonylphenol is added at substantially 1000-3000 ppm.

6. The fuel emulsion of claim 2 wherein a selected alcohol ethoxylate is a C11 alcohol ethoxylate with 5 moles of ethylene oxide per mole of alcohol.

7. The fuel emulsion of claim 1 wherein said surfactant is at least one selected from a group consisting of:

octylphenoxypolyethoxyethanol added to said fuel emulsion at substantially 100-300 parts per million of said fuel emulsion, octylphenol aromatic ethoxylate added at substantially 1000-3000 parts per million of said fuel emulsion, and ethoxylated alkyl phenol added at substantially 1000-2000 parts per million of said fuel emulsion.

8. The fuel emulsion of claim 1 wherein said lubricant is at least one acid selected from a group consisting of: a mono-acid, a di-acid, and a tri-acid.

9. The fuel emulsion of claim 8 wherein said selected one acid is a one selected from a group consisting of: a phosphoric acid adducted to an organic backbone and a carboxylic acid adducted to an organic backbone.

10. The fuel emulsion of claim 9 wherein said organic backbone includes from about 12 to 22 carbon molecules.

11. The fuel emulsion of claim 9 wherein said selected at least one acid is said phosphoric acid adducted to said organic backbone that includes mixed esters of alkoxylated surfactants in phosphate form.

12. The fuel emulsion of claim 9 wherein said selected at least one acid is said phosphoric acid adducted to said organic backbone that includes a one selected from the group consisting of a di-acid of the Diels-Alder adducts of unsaturated fatty acids and a tri-acid of the Diels-Alder adducts of unsaturated fatty acids.

13. The fuel emulsion of claim 1 wherein said additives includes a neutralizer that is an alkanolamine.

14. The fuel emulsion of claim 13 wherein said alkanolamine includes one selected from a group consisting of: amino methyl propanol, triethanolamine, and diethanolamine.

15. The fuel emulsion of claim 1 wherein said additives include said corrosion inhibitor wherein said corrosion inhibitor is an aminoalkanoic acid.

16. The fuel emulsion of claim 1 wherein said additive includes said ignition delay modifier which includes one selected from a group consisting of a nitrate, a nitrite, and peroxide.

17. The fuel emulsion of claim 1 wherein said additive includes said ignition delay modifier that is 2-ethylhexylnitrate.

18. The fuel emulsion of claim 1 further comprising:

anti-freeze being substantially 2%-9% by weight of said fuel emulsion.

19. The fuel emulsion of claim 18 wherein said anti-freeze is an organic alcohol.

* * * * *